US009330651B1

(12) United States Patent
Wang

(10) Patent No.: US 9,330,651 B1
(45) Date of Patent: May 3, 2016

(54) ACOUSTIC ABSORBING COMBINATION

(71) Applicant: Hong Jen Wang, Kaohsiung (TW)

(72) Inventor: Hong Jen Wang, Kaohsiung (TW)

( * ) Notice: Subject to any disclaimer, the term of this patent is extended or adjusted under 35 U.S.C. 154(b) by 0 days.

(21) Appl. No.: 14/800,802

(22) Filed: Jul. 16, 2015

(51) Int. Cl.
*E04B 1/84* (2006.01)
*G10K 11/00* (2006.01)

(52) U.S. Cl.
CPC ..... *G10K 11/002* (2013.01)

(58) Field of Classification Search
CPC ..... E04B 2001/8419; E04B 2001/8428; E04B 2001/8452
USPC ..... 181/207, 210, 224, 286, 288, 292, 293
See application file for complete search history.

(56) References Cited

U.S. PATENT DOCUMENTS 3,846,949 A 11/1974 Okawa
4,130,682 A * 12/1978 Lauko ..... B32B 3/12 181/290
5,004,070 A * 4/1991 Wang ..... E04B 1/86 181/286
5,185,504 A * 2/1993 Jen ..... E04B 1/86 181/286
5,491,310 A 2/1996 Jen
5,670,758 A * 9/1997 Borchers ..... B64G 1/002 181/286
6,125,965 A * 10/2000 Wang ..... E04B 1/86 181/286
6,457,554 B1 10/2002 Wang
7,451,855 B2 11/2008 Wang

* cited by examiner

*Primary Examiner* — Jeremy Luks
(74) *Attorney, Agent, or Firm* — Charles E. Baxley

(57) ABSTRACT

An acoustic absorbing combination includes a receptacle having a chamber formed by an outer peripheral wall and a bottom wall, a number of acoustic absorbing devices are arranged in the chamber of the receptacle and each include a housing having a number of couplers extended out of the housing, and an assembling device includes a number of plates extended radially and outwardly from a center member for engaging with the couplers of the housings and for securing the housings together. The assembling device includes a bead formed on each of the plates for detachably engaging with the couplers of the housing.

6 Claims, 2 Drawing Sheets

ACOUSTIC ABSORBING COMBINATION

BACKGROUND OF THE INVENTION

1. Field of the Invention

The present invention relates to an acoustic absorbing combination, and more particularly to an acoustic absorbing combination including an assembling mechanism for connecting or coupling the acoustic absorbing devices or units together and for allowing the acoustic absorbing devices or units to be easily and quickly secured or attached to various support members or devices, and also for solidly and stably retaining or positioning the acoustic absorbing devices or units relative to each other.

2. Description of the Prior Art

Various kinds of typical acoustic absorbing devices have been developed and disposed on the side portions of the roadways, bridges, etc. for absorbing the sounds or noises and for preventing the sounds or noises from annoying the residents located near the roadways, the bridges, or the like.

For example, U.S. Pat. No. 3,846,949 to Okawa, U.S. Pat. No. 5,491,310 to Jen, and U.S. Pat. No. 6,457,554 to Wang disclose several of the typical sound insulating blocks each comprising a specially shaped or configured sound absorbing plate fixed inside a cover which is then tightly closed in a block for sound or noise absorbing purposes, for allowing the typical sound insulating blocks to be stacked together to form a sound insulating wall.

However, the typical sound insulating blocks may not be easily attached to the other supporting members in the house buildings and thus may not be used for suitably absorbing the sounds or noises in the house buildings.

U.S. Pat. No. 7,451,855 to Wang discloses another typical acoustic board comprising a perforated front silencer disposed within a conical hood which is then disposed or engaged within an outer housing, and a cover threadedly engaged with the large end of the conical hood, and a rear silencer provided in the small end of the conical hood for isolating the noise.

However, the typical acoustic board comprising an outer cover disposed and engaged with the outer portion of the conical hood such that the entering of the sounds or noises into the conical hood, and the specially shaped or configured sound or acoustic absorbing members of the typical acoustic absorber may not be solidly and stably retained or positioned relative to each other in the support members or devices.

The present invention has arisen to mitigate and/or obviate the afore-described disadvantages of the conventional acoustic absorbing combinations.

SUMMARY OF THE INVENTION

The primary objective of the present invention is to provide an acoustic absorbing combination including an assembling mechanism for connecting or coupling the acoustic absorbing devices or units together and for allowing the acoustic absorbing devices or units to be easily and quickly secured or attached to various support members or devices, and also for solidly and stably retaining or positioning the acoustic absorbing devices or units relative to each other.

In accordance with one aspect of the invention, there is provided an acoustic absorbing combination comprising a receptacle including a chamber formed therein, and including an outer peripheral wall and a bottom wall for forming the chamber of the receptacle, a number of acoustic absorbing devices arranged in the chamber of the receptacle, the acoustic absorbing devices each including a housing having a number of couplers extended out of the housing, and an assembling device including a number of plates extended radially and outwardly therefrom for engaging with the couplers of the housings and for detachably securing the housings together.

The assembling device includes a center member, and the plates are extended radially and outwardly from the center member. The assembling device includes a bead provided on each of the plates for engaging with the couplers of the housing. The couplers of the housings each include a bore formed therein for engaging with the bead of the plate, and a slot formed therein and communicating with the bore of the coupler for engaging with the plate.

The housings each include a compartment formed therein, and each include an acoustic absorbing facility engaged in the compartment of the housing. The housings each include a number of columns extended in the compartment of the housing, and an acoustic absorbing facility engaged in the compartment of the housing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
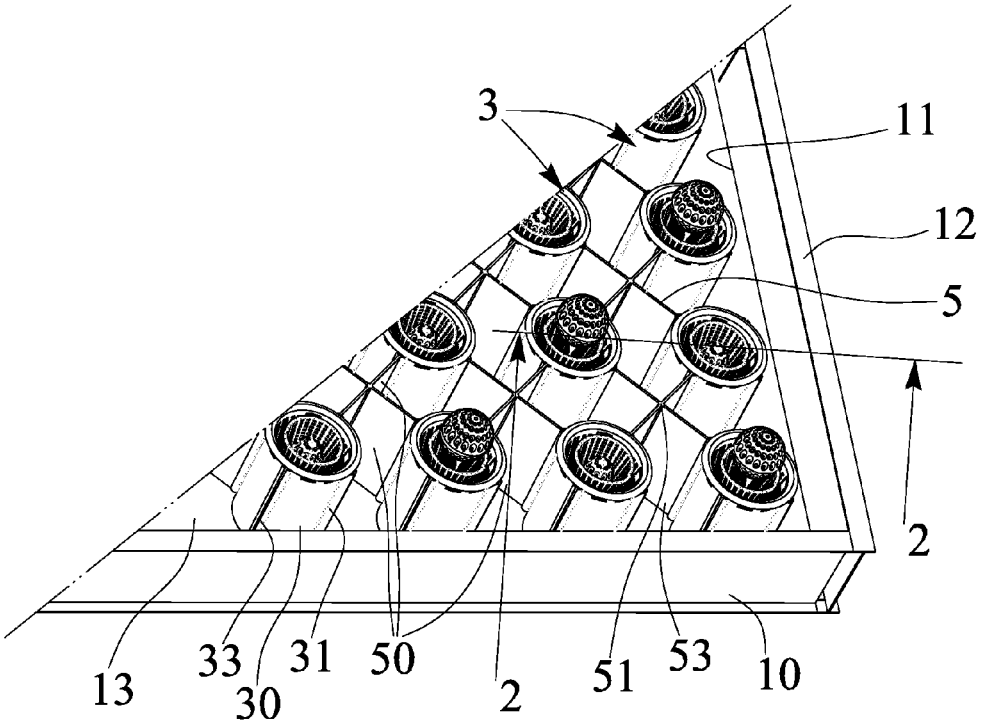
FIG. 1 is a partial perspective view of an acoustic absorbing combination in accordance with the present invention.
Figure 2:
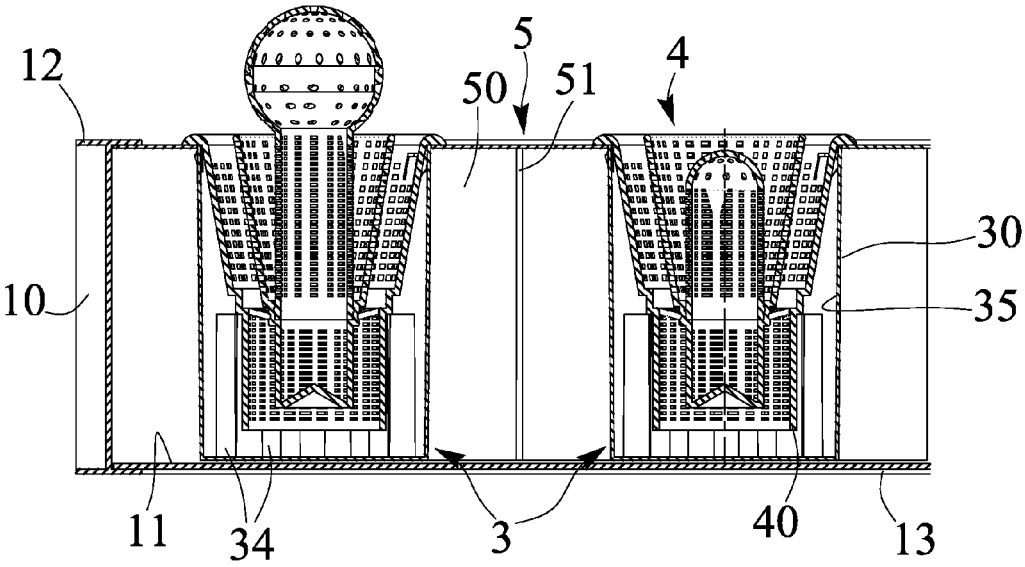
FIG. 2 is a partial cross sectional view of the acoustic absorbing combination, taken along lines 2-2 of FIG. 1.

Referring to the drawings, and initially to FIGS. 1-2, an acoustic absorbing combination in accordance with the present invention comprises an outer container or receptacle 10 including a chamber 11 formed therein and defined by an outer peripheral wall 12 and a bottom wall 13, or the outer receptacle 10 includes an outer peripheral wall 12 and a bottom wall 13 for forming or defining the chamber 11 therein, and the acoustic absorbing combination further includes a number of acoustic absorbing units or devices 3 to be disposed and arranged within the chamber 11 of the outer receptacle 10, and assembled together with a coupling or supporting member, or assembling mechanism or device 5.

The acoustic absorbing devices 3 each include an outer housing 30 having a cylindrical shape or structure or configuration, and the housing 30 includes one or more (such as four) posts or couplers 31 extended out of the outer peripheral portion of the housing 30, and the couplers 31 each include a bore 32 formed therein and a slot 33 formed therein and communicating with the bore 32 thereof for coupling the housing 30 to the assembling device 5. It is preferable, but not necessary that the couplers 31 are equally spaced from each other and each include a cylindrical shape or structure or configuration.

Figure 3:
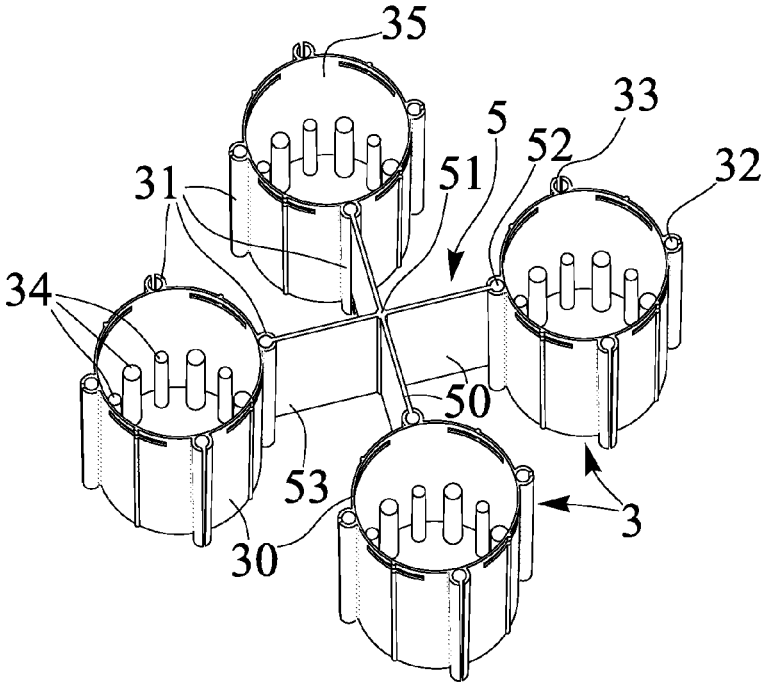
FIG. 3 is an enlarged partial perspective view of the acoustic absorbing combination.
Figure 4:
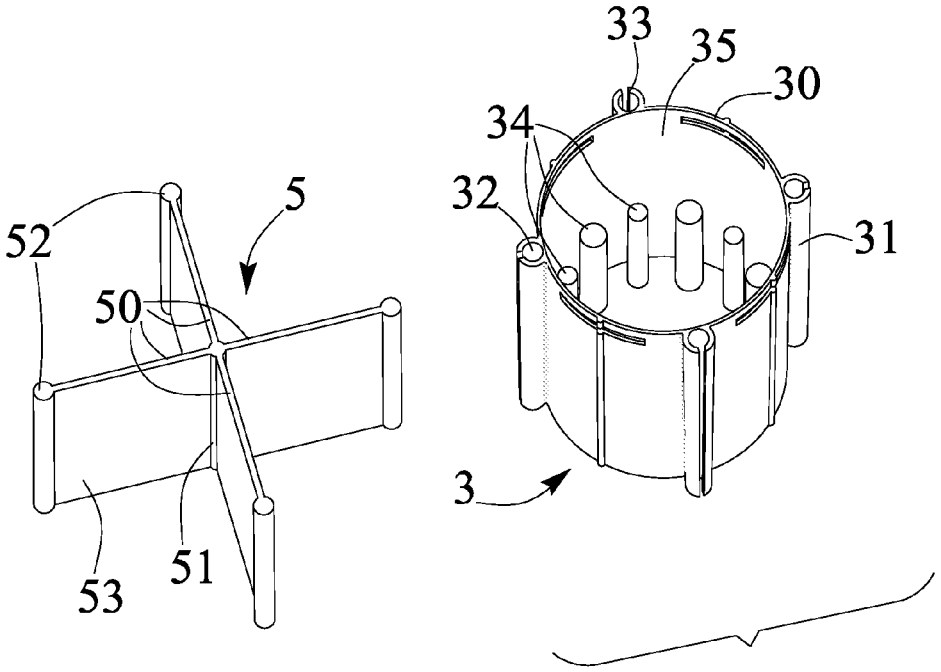
FIG. 4 is a partial exploded view of the acoustic absorbing combination.

The housing 30 includes a number of rods or posts or columns 34 extended in the inner compartment 35 thereof (FIGS. 2-4) for interfering the sound or noise entered or transmitted into the compartment 35 of the housing 30 and for absorbing the sound or noise, and for engaging with and for anchoring or locking or latching or positioning a hood 40 of an acoustic absorbing facility 4 in the compartment 35 of the housing 30, and for detachably fixing or locking or latching or securing the hood 40 of the acoustic absorbing facility 4 to the housing 30. The above-described structure or configuration for the acoustic absorbing facility 4 is typical and is not related to the present invention and will not be described in further details.

The assembling mechanism or device 5 includes one or more (such as four) flaps or plates 50 extended radially and outwardly from a center portion or member 51 for engaging with the slot 33 of the coupler 31 of the housing 30 and for anchoring or securing the housings 30 together, and includes a circular or rounded rib or bead 52 formed or provided on the outer or free end portion 53 of each of the plates 50 for selectively engaging into or with the bore 32 of the coupler 31 and for detachably latching or securing or connecting or coupling the housings 30 of the acoustic absorbing devices 3 together, and for allowing the acoustic absorbing devices 3 to be easily and quickly secured or attached to the outer receptacle 10, and also for solidly and stably retaining or positioning the acoustic absorbing devices 3 relative to each other.

In operation, as shown in FIGS. 1 and 2, the plates 50 of the assembling device 5 may include a predetermined length, width, dimension, standard, shape, structure or configuration for engaging with the housings 30 and for suitably spacing or separating the housings 30 from each other, and for allowing the housings 30 of the acoustic absorbing devices 3 to be easily and quickly secured or attached to and engaged in the chamber 11 of the outer receptacle 10, and also for solidly and stably retaining or positioning the housings 30 of the acoustic absorbing devices 3 relative to each other without much measuring work.

Accordingly, the acoustic absorbing combination in accordance with the present invention includes an assembling mechanism for connecting or coupling the acoustic absorbing devices or units together and for allowing the acoustic absorbing devices or units to be easily and quickly secured or attached to various support members or devices, and also for solidly and stably retaining or positioning the acoustic absorbing devices or units relative to each other.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An acoustic absorbing combination comprising:

a receptacle including a chamber formed therein, and including an outer peripheral wall and a bottom wall for forming said chamber of said receptacle, a plurality of acoustic absorbing devices arranged in said chamber of said receptacle, said acoustic absorbing devices each including a housing having a plurality of couplers extended out of said housing, and an assembling device including a plurality of plates extended radially and outwardly therefrom for engaging with said couplers of said housings and for securing said housings together.

2. The acoustic absorbing combination as claimed in claim 1, wherein said assembling device includes a center member, and said plates are extended radially and outwardly from said center member.

3. The acoustic absorbing combination as claimed in claim 1, wherein said assembling device includes a bead provided on each of said plates for engaging with said couplers of said housing.

4. The acoustic absorbing combination as claimed in claim 3, wherein said couplers of said housings each include a bore formed therein for engaging with said bead of said plate, and a slot formed therein and communicating with said bore of said coupler for engaging with said plate.

5. The acoustic absorbing combination as claimed in claim 1, wherein said housings each include a compartment formed therein, and each include an acoustic absorbing facility engaged in said compartment of said housing.

6. The acoustic absorbing combination as claimed in claim 5, wherein said housings each include a plurality of columns extended in said compartment of said housing, and an acoustic absorbing facility engaged in said compartment of said housing.

* * * * *